US010316385B2

(12) United States Patent
Ichimiya et al.

(10) Patent No.: US 10,316,385 B2
(45) Date of Patent: Jun. 11, 2019

(54) HIGH-TENSILE-STRENGTH STEEL PLATE AND PROCESS FOR PRODUCING SAME

(71) Applicant: JFE STEEL CORPORATION, Tokyo (JP)

(72) Inventors: Katsuyuki Ichimiya, Tokyo (JP); Masao Yuga, Tokyo (JP); Kazukuni Hase, Tokyo (JP); Shigeru Endo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 243 days.

(21) Appl. No.: 15/129,896

(22) PCT Filed: Mar. 31, 2015

(86) PCT No.: PCT/JP2015/001868
§ 371 (c)(1),
(2) Date: Sep. 28, 2016

(87) PCT Pub. No.: WO2015/151519
PCT Pub. Date: Oct. 8, 2015

(65) Prior Publication Data

US 2017/0137905 A1 May 18, 2017

(30) Foreign Application Priority Data

Mar. 31, 2014 (JP) ..... 2014-073742

(51) Int. Cl.

| | |
|---|---|
| ***C21D 9/46*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C22C 38/00*** | (2006.01) |
| ***C21D 1/18*** | (2006.01) |
| ***C21D 1/25*** | (2006.01) |
| *C22C 38/18* | (2006.01) |

(52) U.S. Cl.

CPC ..... *C21D 9/46* (2013.01); *C21D 1/18* (2013.01); *C21D 1/25* (2013.01); *C21D 8/0226* (2013.01); *C21D 8/0247* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01)

(58) Field of Classification Search
None
See application file for complete search history.

(56) References Cited

U.S. PATENT DOCUMENTS

| | | | | |
|---|---|---|---|---|
| 6,245,290 | B1 | 6/2001 | Koo et al. | |
| 9,777,358 | B2 * | 10/2017 | Ichimiya | C21D 8/0226 |
| 9,790,579 | B2 * | 10/2017 | Yuga | C22C 38/14 |
| 9,945,015 | B2 * | 4/2018 | Yuga | C21D 8/02 |
| 2007/0051433 | A1 | 3/2007 | Kamo et al. | |
| 2010/0074794 | A1 | 3/2010 | Ahn et al. | |
| 2010/0226813 | A1 | 9/2010 | Kamo et al. | |
| 2014/0246131 | A1 | 9/2014 | Yuga et al. | |
| 2015/0059912 | A1 | 3/2015 | Shimamura et al. | |
| 2015/0075682 | A1 | 3/2015 | Yuga | |
| 2016/0312327 | A1 * | 10/2016 | Ichimiya | C21D 8/02 |
| 2018/0051363 | A1 * | 2/2018 | Shimamura | C21D 8/02 |

(Continued)

FOREIGN PATENT DOCUMENTS

| | | | |
|---|---|---|---|
| CN | 102124133 | A | 7/2011 |
| CN | 102691015 | A | 9/2012 |

(Continued)

OTHER PUBLICATIONS

English translation of JP 2008/023569, Feb. 2008; 22 pages.*

(Continued)

*Primary Examiner* — Helene Klemanski

(74) *Attorney, Agent, or Firm* — RatnerPrestia

(57) ABSTRACT

A high-tensile-strength steel plate is provided with a new chemical composition design that guarantees the same properties as a 50 mm thick steel plate even in a steel plate with a thickness of 100 mm or greater, without the yield stress being affected by the plate thickness. By mass %, the chemical composition includes C: 0.02% to 0.08%, Si: 0.01% to 0.35%, Mn: 1.4% to 2.0%, P: 0.007% or less, S: 0.0035% or less, Al: 0.010% to 0.060%, Ni: 0.5% to 2.0%, Mo: 0.10% to 0.50%, Nb: 0.005% to 0.040%, Ti: 0.005% to 0.025%, B: less than 0.0003%, N: 0.002% to 0.005%, Ca: 0.0005% to 0.0050%, and O: 0.003% or less, with the components additionally satisfying a predetermined relationship.

4 Claims, No Drawings

(56) References Cited

U.S. PATENT DOCUMENTS

| | | | | |
|---|---|---|---|---|
| 2018/0057905 | A1* | 3/2018 | Ota | C21D 8/02 |
| 2018/0105907 | A1* | 4/2018 | Ota | C22C 38/001 |

FOREIGN PATENT DOCUMENTS

| | | | |
|---|---|---|---|
| EP | 1025272 | A1 | 8/2000 |
| EP | 1500457 | A1 | 1/2005 |
| EP | 2147986 | A1 | 1/2010 |
| EP | 2272994 | A1 | 1/2011 |
| EP | 2272994 | | 12/2011 |
| EP | 2799584 | A1 | 11/2014 |
| EP | 2832889 | A1 | 2/2015 |
| JP | 60184663 | | 9/1985 |
| JP | 0353367 | | 8/1991 |
| JP | 05186823 | | 7/1993 |
| JP | 3045856 | B2 | 5/2000 |
| JP | 2001107135 | A | 4/2001 |
| JP | 2001247932 | A | 9/2001 |
| JP | 2001335884 | | 12/2001 |
| JP | 2002235114 | | 8/2002 |
| JP | 2003147484 | | 5/2003 |
| JP | 3697202 | B2 | 9/2005 |
| JP | 2005272854 | | 10/2005 |
| JP | 2005281842 | A | 10/2005 |
| JP | 2006291349 | A | 10/2006 |
| JP | 2008023569 | | 2/2008 |
| JP | 2009041079 | | 2/2009 |
| JP | 2009263777 | | 11/2009 |
| JP | 4432905 | B2 | 3/2010 |
| JP | 2011074403 | | 4/2011 |
| JP | 2012184500 | | 9/2012 |
| JP | 2013091845 | A | 5/2013 |
| JP | 2013151732 | A | 8/2013 |
| JP | 2014029019 | | 2/2014 |
| KR | 20100116701 | A | 11/2010 |
| WO | 2008078917 | A1 | 7/2008 |
| WO | 2010052927 | A1 | 5/2010 |
| WO | 2011096456 | A1 | 8/2011 |
| WO | WO 2013/118313 | A1 * | 8/2013 |
| WO | 2013145770 | A1 | 10/2013 |
| WO | WO 2014/038200 | A1 * | 3/2014 |
| WO | WP 2015/088040 | A1 * | 6/2015 |

OTHER PUBLICATIONS

European Communication for European Application No. 15 774 406.1, dated Jan. 16, 2018, 6 pages.

Korean Office Action for Korean Application No. 10-2016-7027078, dated Nov. 28, 2017, including Concise Statement of Relevance of Office Action, 6 pages.

Chinese Office Action for Chinese Application No. 201580016841.4, dated Nov. 24, 2017, including Concise Statement of Relevance of Office Action, 7 pages.

Chinese Office Action for Chinese Application No. 201580016841.4, dated Apr. 28, 2017 with English Search Report, 7 pages.

Notice of Reasons for Refusal for Japanese Application No. 2016-511393, dated Mar. 14, 2017, including English translation and Concise Statement of Relevance, 11 pages.

Extended European Search Report for European Application No. 15774406.1, dated Apr. 6, 2017, 9 pages.

Notice of Reasons for Refusal for Japanese Application No. 2016-511393, dated Mar. 9, 2017, including English translation, 7 pages.

International Search Report and Written Opinion for International Application No. PCT/JP2015/001868, dated May 26, 2015, 7 pages.

European Communication for European Application No. 15 774 406.1, dated Jun. 5, 2018, 6 pages.

Korean Office Action for Korean Application No. 10-2016-7027078, dated Jul. 5, 2018, with Concise Statement of Relevance of Office Action, 5 pages.

* cited by examiner

HIGH-TENSILE-STRENGTH STEEL PLATE AND PROCESS FOR PRODUCING SAME

CROSS REFERENCE TO RELATED APPLICATIONS

This is the U.S. National Phase application of PCT/JP2015/001868, filed Mar. 31, 2015, which claims priority to Japanese Patent Application No. 2014-073742, filed Mar. 31, 2014, the disclosures of each of these applications being incorporated herein by reference in their entireties for all purposes.

TECHNICAL FIELD

This disclosure relates to a high-tensile-strength steel plate used in steel structures such as ships, marine structures, pressure vessels, and penstocks and to a process for producing the high-tensile-strength steel plate. In particular, this disclosure relates to a high-tensile-strength steel plate that not only has yield stress (YS) of 460 MPa or greater and excellent strength and toughness of base metal, but that also, when forming a multilayer weld, has excellent low temperature toughness in the weld zone, and to a process for producing the high-tensile-strength steel plate.

BACKGROUND

Steel used in ships, marine structures, pressure vessels, and the like is welded to form structures with desired shapes. Therefore, from the perspective of structural safety, these steels are not only required to have base metal with high strength and excellent toughness but also to have excellent toughness in weld joints (weld metal and Heat-Affected Zone (HAZ)).

The absorbed energy by a Charpy impact test has mainly been used as the basis for evaluating the toughness of steel. In recent years, however, a Crack Tip Opening Displacement test (CTOD test; the evaluation results of this test are referred to below as CTOD property or CTOD value) has often been used for greater reliability. This test evaluates the resistance to occurrence of brittle fracture by generating a fatigue precrack in a test piece at the location of toughness evaluation, subjecting the test piece to three-point bending, and measuring the amount of the crack opening (plastic deformation volume) immediately before fracture.

Since a fatigue precrack is used in this CTOD test, an extremely small region is evaluated for toughness. If a local brittle zone exists, a low toughness may in some cases be indicated, even if a good toughness is obtained with a Charpy impact test.

When forming a multilayer fill weld in a thick steel plate or the like, the local brittle zones easily occur in the Heat-Affected Zone (HAZ), which is subjected to a complicated thermal history. Specifically, the bond (the boundary between weld metal and base metal) and a region in which the bond is formed into a dual phase region by reheating (a region in which coarse grains are formed in the first cycle of welding and which is heated into a ferrite and austenite dual phase region by the subsequent welding pass, hereinafter referred to as a dual phase reheating area) become local brittle zones.

Since the bond is exposed to a high temperature just below the melting point, austenite grains are coarsened and are likely to be transformed, by the subsequent cooling, into an upper bainite structure that has a low toughness. Therefore, the toughness of the matrix itself is low. Furthermore, brittle structures such as a Widmanstatten structure or isolated martensite (MA: Martensite Austenite constituent) easily occur in the bond, resulting in an even lower toughness.

In order to improve the toughness of the heat-affected zone, for example a technique that incorporates TiN in the steel by fine particle distribution to reduce coarsening of austenite grains and to create ferrite nucleation sites has been put to practical use. The bond, however, may be heated to a temperature region at which TiN dissolves. As the demand for low temperature toughness of the weld zone becomes more stringent, it becomes more difficult to obtain the above-described effect.

JP H03-053367 B2 (PTL 1) and JP S60-184663 A (PTL 2) disclose techniques in which, by dispersing fine grains in steel by means of combined addition of rare-earth elements (REM) and Ti, grain growth of austenite is suppressed, thereby improving the toughness of the weld zone.

A technique for dispersing Ti oxides, a technique for combining the capability of ferrite nucleation of BN with oxide dispersion, and a technique for adding Ca and a REM to control the morphology of sulfides so as to increase the toughness have also been proposed.

These techniques target relatively low strength steel material with a small amount of alloying elements. Unfortunately, these techniques cannot be applied to higher strength steel material with a large amount of alloying elements, since the HAZ structure does not include ferrite.

Therefore, as a technique for facilitating generation of ferrite in the heat-affected zone, JP 2003-147484 A (PTL 3) discloses a technique that mainly increases the added amount of Mn to 2% or more. With continuous casting material, however, Mn tends to segregate in the central portion of the slab. The central segregation area becomes harder not only in the base metal but also in the heat-affected zone and becomes the origin of fracture, thereby triggering a reduction in the base metal and HAZ toughness.

On the other hand, in the dual phase reheating area, carbon becomes concentrated in a region where reverse transformation to austenite occurs due to dual phase reheating, and brittle bainite structures including isolated martensite are generated during cooling, resulting in reduced toughness. Therefore, techniques have been disclosed to reduce the contents of C and Si in the steel chemical composition, inhibit the generation of isolated martensite, and improve the toughness, and to ensure the base metal strength by adding Cu (for example, JP H05-186823 A (PTL 4) and JP 2001-335884 A (PTL 5)). These techniques increase the strength by precipitating Cu by aging treatment, but since a large amount of Cu is added, the hot ductility deteriorates, inhibiting productivity.

Steel structures such as ships, marine structures, pressure vessels, and penstocks have increased in size, leading to a desire for even higher strength steel material. The steel material used in these steel structures is often thick material, for example with a plate thickness of 35 mm or more to 100 mm or less. Therefore, in order to ensure a strength such that the yield stress is at least 420 MPa grade, a steel chemical composition with a large amount of alloying elements is advantageous. In a steel chemical composition with a large amount of alloying elements, however, it is difficult to guarantee toughness of the bond and the dual phase reheating area, as described above.

With regard to this point, JP 2012-184500 A (PTL 6) proposes achieving yield stress of 420 MPa or higher and good low temperature toughness (CTOD property) even in a steel chemical composition with a large amount of alloying elements by specifying the equivalent carbon content Ceq based on a predetermined chemical composition. This proposed technique can provide a high-tensile-strength steel plate, and a process for producing the same, that has yield stress (YS) of 420 MPa or higher, which is a value suitable in steel structures for the aforementioned uses, and that has an excellent low temperature toughness (CTOD property) in the heat-affected zone of a multilayer weld formed by low to medium heat input.

CITATION LIST

Patent Literature

PTL 1: JP 1403-053367 B2
PTL 2: JP S60-184663 A
PTL 3: JP 2003-147484 A
PTL 4: JP H05-186823 A
PTL 5: JP 2001-335884 A
PTL 6: JP 2012-184500 A

SUMMARY

Technical Problem

In recent years, steel structures for the aforementioned uses have become increasingly thicker and larger. Among such steel structures, there is demand for the provision of thick material with a high yield stress (YS) and with excellent low temperature toughness of the heat-affected zone (CTOD property) for ships and marine structures. In particular, there is a strong desire for a thick plate having an excellent CTOD property, yield stress of 460 MPa or more, and a plate thickness of 35 mm or more to 100 mm or less.

The aforementioned technique disclosed in PTL 6 pioneers a method for achieving a yield stress of 420 MPa or higher and good low temperature toughness (CTOD property) even for a steel chemical composition with a large amount of alloying elements. For a thick plate with a thickness for example exceeding 50 mm, however, this technique does not yield sufficient properties equivalent to those of a 50 mm thick steel plate. In other words, according to the technique disclosed in PTL 6, a yield stress of 500 MPa or higher is obtained for a steel plate of 50 mm, but when the plate thickness exceeds 50 mm, the yield stress falls to 462 MPa for a plate thickness of 70 mm. The yield stress is thus affected by the plate thickness.

Furthermore, as disclosed in PTL 6, the CTOD property has been shown to deteriorate upon simply adding elements to a material that is 420 MPa grade or higher in order to further strengthen the steel.

It would therefore be helpful to provide a steel plate that, even with a thickness of 35 mm to 100 mm, has a yield stress of 460 MPa or higher and stably exhibits a CTOD of 0.5 mm or greater.

Solution to Problem

Based on the following technical concepts, we specifically designed the chemical composition of steel, thereby completing this disclosure.

i) Since the CTOD property is evaluated with a test piece having the entire thickness of the steel plate, the central segregation area where components are concentrated becomes the origin of fracture. Consequently, in order to improve the CTOD property of the heat-affected zone, elements that easily concentrate as central segregation of the steel plate are controlled to a proper amount, thereby suppressing the hardening of the central segregation area. At the center of the slab, which is the last portion to solidify when the molten steel solidifies, the concentration of C, Mn, P, Ni, and Nb is higher than the concentration of other elements. Hence, the added amounts of these elements are controlled on the basis of the central segregation area hardness index, thereby reducing the hardness of the central segregation area.

ii) In order to improve the toughness of the heat-affected zone, TiN is used efficiently to suppress coarsening of the austenite grains in the vicinity of the weld bond. Controlling the Ti/N ratio to an appropriate level allows uniform fine particle distribution of TiN in the steel.

iii) Crystallization of the Ca compound (CaS), which is added for morphological control of sulfides, is used to improve the toughness of the heat-affected zone. Since CaS crystallizes at a low temperature as compared to oxides, CaS can be distributed uniformly as fine particles. Furthermore, by controlling the amount of CaS added and the amount of dissolved oxygen in the molten steel at the time of addition to be within appropriate ranges, solute S can also be guaranteed after CaS crystallization. Hence, MnS precipitates on the surface of the CaS to form a complex sulfide. Since a Mn dilute zone is formed around the MnS, ferrite transformation is further promoted.

iv) The CTOD value and strength are a trade-off. Therefore, upon increasing Ceq in a conventional high C, high P composition, the CTOD value becomes insufficient. To address this problem, we discovered that a chemical composition with low C, low P, and high Ni improves the balance between strength and CTOD value.

Specifically, the primary features of this disclosure are as described below.

1. A high-tensile-strength steel plate, comprising:
   a chemical composition including, by mass %,
   C: 0.02% to 0.08%,
   Si: 0.01% to 0.35%,
   Mn: 1.4% to 2.0%,
   P: 0.007% or less,
   S: 0.0035% or less,
   Al: 0.010% to 0.060%,
   Ni: 0.5% to 2.0%,
   Mo: 0.10% to 0.50%,
   Nb: 0.005% to 0.040%,
   Ti: 0.005% to 0.025%,
   B: less than 0.0003%,
   N: 0.002% to 0.005%,
   Ca: 0.0005% to 0.0050%, and
   O: 0.0030% or less,
   Ceq specified by formula (1) below being from 0.420 to 0.520, Ti/N being from 1.5 to 4.0, formulas (2) and (3) below being satisfied, and a balance being Fe and incidental impurities:

$$Ceq=[C]+[Mn]/6+([Cu]+[Ni])/15+([Cr]+[Mo]+[V])/5 \quad (1)$$

$$0<\{[Ca]-(0.18+130\times[Ca])\times[O]\}/1.25/[S]<1 \quad (2)$$

$$5.5[C]^{4/3}+15[P]+0.90[Mn]+0.12[Ni]+7.9[Nb]^{1/2}+0.53[Mo]\leq 3.70 \quad (3)$$

where brackets [ ] indicate the content by mass % of the element in the brackets.
2. The high-tensile-strength steel plate of 1, wherein the chemical composition further includes, by mass %, at least one selected from the group consisting of:
   Cu: 0.7% or less, Cr: 0.1% to 1.0%, and V: 0.005% to 0.050%.

3. The high-tensile-strength steel plate of 1 or 2, wherein a hardness of a central segregation area of the steel plate satisfies formula (4) below:

$$Hv\max/Hv\text{ave} \leq 1.35+0.006/[C]-t/500 \quad (4)$$

where Hvmax is a maximum Vickers hardness of the central segregation area,

Hvave is an average Vickers hardness of a portion excluding the central segregation area and sections from both front and back surfaces inward to ¼ of a plate thickness,

[C] is the C content by mass %, and t is a plate thickness of the steel plate in millimeters.

4. A method for producing a high-tensile-strength steel plate, the method comprising:

heating steel having the chemical composition of 1 or 2 to a temperature from 1030° C. to 1200° C.;

subsequently subjecting the steel to hot rolling at a cumulative rolling reduction of 30% or higher in a temperature range of 950° C. or higher and a cumulative rolling reduction of 30% to 70% in a temperature range of less than 950° C.;

subsequently cooling the steel to 600° C. or below with a cooling rate of 1.0° C./s or higher; and subsequently tempering the steel at 450° C. to 650° C.

Advantageous Effect

We thus stably provide a high-tensile-strength steel plate that, even at a thickness of 35 mm or more to 100 mm or less, has yield stress (YS) of 460 MPa or higher, which is a value suitable for use in large steel structures such as marine structures, and has an excellent low temperature toughness, in particular an excellent CTOD property, in the heat-affected zone of a multilayer weld formed by low to medium heat input.

DETAILED DESCRIPTION

Our methods and products will be described in detail below. First, reasons why the chemical composition of the steel has been restricted to the aforementioned ranges will be described for each element. The % representations below indicating the chemical composition of the steel are by mass % unless stated otherwise.

C: 0.02% to 0.08%

C is a necessary element for ensuring the base metal strength of a high-tensile-strength steel plate. When the C content is less than 0.02, quench hardenability is degraded, and it becomes necessary to add a large amount of quench hardenability-improving elements, such as Cu, Ni, Cr, or Mo, in order to ensure strength, resulting in a rise in costs and degradation of weldability. Conversely, when the C content exceeds 0.080%, the toughness of the weld zone degrades. Therefore, the C content is set in the range of 0.02% to 0.08%, preferably 0.07% or less, and more preferably 0.03% to 0.07%.

Si: 0.01% to 0.35%

Si is added as a deoxidizing material and in order to obtain base metal strength. Adding a large amount exceeding 0.30%, however, leads to deterioration in weldability and toughness of the weld joint. Therefore, the Si content needs to be set in the range of 0.01% to 0.35%, preferably 0.23% or less, and more preferably 0.01% to 0.20%.

Mn: 1.4% to 2.0%

In order to ensure the base metal strength and the weld joint strength, Mn is added to a content of 1.4% or more. Upon the Mn content exceeding 2.0%, however, weldability deteriorates, quench hardenability becomes excessive, and the toughness of the base metal and the toughness of the weld joint deteriorate. Therefore, the Mn content is set in a range of 1.4% to 2.0%, and more preferably 1.40% to 1.85%.

P: 0.007% or less

P is an impurity element and degrades the toughness of the base metal and the toughness of the weld zone. In particular, when the P content in the weld zone exceeds 0.007%, the CTOD property markedly degrades. Therefore, the P content is set to 0.007% or less.

Here, in particular in order to improve the CTOD property, it is necessary to add Ni to a content of 0.5% or more in addition to setting the content of P to 0.007% or less and of C to 0.070% or less. The reason is that P makes the matrix brittle and deteriorates the central segregation, and C promotes central segregation and increases isolated martensite, thereby causing the toughness of the weld zone to deteriorate. On the other hand, Ni improves the toughness of the weld zone by increasing the toughness of the matrix.

S: 0.0035% or less

S is an impurity element that is mixed in inevitably. When the content thereof exceeds 0.0035%, the toughness of the base metal and the weld zone deteriorates. Therefore, the content is set to 0.0035% or less, preferably 0.0030% or less.

Al: 0.010% to 0.060%

Al is an element to be added in order to deoxidize molten steel, and the Al content needs to be set to 0.010% or more. When the Al content exceeds 0.060%, however, the toughness of the base metal and the weld zone is degraded, and Al is mixed into the weld metal by dilution due to welding, thereby degrading toughness. Therefore, the Al content is limited to 0.060% or less and is preferably 0.017% to 0.055%. In this disclosure, the Al content is specified in terms of acid-soluble Al (also referred to as "Sol.Al" or the like).

Ni: 0.5% to 2.0%

Ni is an element useful for improving the strength and toughness of steel and is also useful for improving the CTOD property of the weld zone. In order to obtain these effects, the added content of Ni needs to be 0.5% or more. Ni is an expensive element, however, and excessive addition thereof also increases the likelihood of damage to the surface of the slab at the time of casting. Therefore, the upper limit of the Ni content is set to 2.0% and is more preferably 0.5% to 1.8%.

Mo: 0.10% to 0.50%

Mo is a useful element for increasing the strength of the base metal. This effect is particularly strong in high-strength steel material. In order to produce such an effect, the Mo content is preferably 0.10% or more. However, since excess Mo adversely affects toughness, the Mo content is set to 0.50% or less and is more preferably 0.15% to 0.40%.

Nb: 0.005% to 0.040%

Nb contributes to the formation of an unrecrystallized zone of austenite in the low temperature region. At that time, by performing rolling in such a temperature region, the structure of the base metal can be refined and the toughness of the base metal can be increased. Furthermore, Nb has the effect of improving the quench hardenability and of improving the resistance to temper softening and is a useful element for improving the strength of the base metal. In order to obtain these effects, the Nb content needs to be at least 0.005%. When the Nb content exceeds 0.040%, however, the toughness deteriorates. Hence, the upper limit on the Nb content is set to 0.040%, preferably 0.035%.

Ti: 0.005% to 0.025%

Ti is precipitated as TiN when molten steel solidifies, which suppresses coarsening of austenite in the weld zone, thus contributing to improvement in the toughness of the weld zone. When the Ti content is less than 0.005%, however, such an effect is small. On the other hand, when the Ti content exceeds 0.025%, TiN coarsens, and it is not possible to obtain the effect of improving the toughness of the base metal and the weld zone. Therefore, the Ti content is set to be from 0.005% to 0.025%, and more preferably 0.006% to 0.020%.

B: less than 0.0003%

When steel is cooled from the austenite region, B exists in a segregated manner at austenite grain boundaries, suppresses ferrite transformation, and generates bainite structures that include a large amount of isolated martensite (M-A). The addition of B makes the structure brittle particularly in the heat-affected zone and is therefore limited to less than 0.0003%.

N: 0.002% to 0.005%

N reacts with Ti and Al to form precipitates. Crystal grains are thereby refined, and the toughness of the base metal is improved. Furthermore, N is a necessary element for forming TiN, which suppresses coarsening of the structure of the weld zone. In order to obtain such effects, the N content needs to be set to 0.002% or more. On the other hand, when the N content exceeds 0.005%, solute N markedly degrades the toughness of the base metal and the weld zone and leads to a deterioration in strength due to a reduction in solute Nb caused by generation of complex precipitates of TiNb. Therefore, the upper limit on the N content is set to 0.005%, and is more preferably 0.0025% to 0.0045%.

Ca: 0.0005% to 0.0050%

Ca is an element that improves toughness by fixing S. In order to obtain this effect, the Ca content needs to be at least 0.0005%. Ca content exceeding 0.0050%, however, causes saturation of the effect. Therefore, Ca is added in the range of 0.0005% to 0.0050%, and more preferably 0.0008% to 0.0040%.

O: 0.0030% or less

If the O content exceeds 0.0030%, the toughness of the base metal deteriorates. Hence, the O content is set to 0.0030% or less, preferably 0.0025% or less.

It is also crucial that Ceq as specified by formula (1) below be 0.420 to 0.520, that Ti/N be 1.5 to 4.0, and that formulas (2) and (3) below be satisfied, where the brackets [ ] in each formula indicate the content (mass %) of the element in the brackets.

$$Ceq=[C]+[Mn]/6+([Cu]+[Ni])/15+([Cr]+[Mo]+[V])/5 \quad (1)$$

$$0<\{[Ca]-(0.18+130\times[Ca])\times[O]\}/1.25/[S]<1 \quad (2)$$

$$5.5[C]^{4/3}+15[P]+0.90[Mn]+0.12[Ni]+7.9[Nb]^{1/2}+0.53[Mo]\leq 3.70 \quad (3)$$

Ceq: 0.420 to 0.520

When Ceq specified by formula (1) is less than 0.420, a strength that has 460 MPa grade yield stress is difficult to obtain. In particular, it is crucial to design the chemical composition so that Ceq is 0.420 or higher not only to ensure 460 MPa grade strength in a steel plate that is approximately 35 mm to 50 mm thick, but also to ensure 460 MPa grade strength similarly in a steel plate with a thickness of 50 mm or greater. Ceq preferably exceeds 0.440, so as to ensure a strength exceeding 560 MPa.

On the other hand, if Ceq exceeds 0.520, the weldability and the toughness of the weld zone deteriorate. Hence, Ceq is set to 0.520 or less. Ceq is preferably 0.50 or less.

Ti/N: 1.5 to 4.0

When the value of Ti/N is less than 1.5, the amount of TiN formed decreases, and solute N not forming TiN degrades the toughness of the weld zone. When the value of Ti/N exceeds 4.0, TiN is coarsened and degrades the toughness of the weld zone. Accordingly, the range of Ti/N is 1.5 to 4.0, preferably 1.8 to 3.5. Ti/N is the ratio of the content (mass %) of each element.

$$0<\{[Ca]-(0.18+130\times[Ca])\times[O]\}/1.25/[S]<1$$

The expression $\{[Ca]-(0.18+130\times[Ca])\times[O]\}/1.25/[S]$ is a value representing the Atomic Concentration Ratio (ACR) of Ca and S, which are effective for sulfide morphological control. The sulfide morphology can be estimated by this value, and this value needs to be specified in order to finely disperse CaS which does not dissolve even at high temperatures and which acts as nuclei for ferrite transformation. In other words, when ACR is 0 or less, CaS is not crystallized. Consequently, S is precipitated in the form of MnS only, thereby making it impossible to obtain ferrite product nuclei in the heat-affected zone. Furthermore, the MnS precipitated alone is elongated during rolling and causes degradation in the toughness of the base metal.

On the other hand, when ACR is 1 or greater, S is completely fixed by Ca, and MnS that functions as a ferrite product nucleus is no longer precipitated on CaS. Therefore, complex sulfides can no longer achieve the fine dispersion of ferrite product nuclei, making it impossible to obtain the effect of improving toughness. In this way, when ACR is greater than 0 and less than 1, MnS precipitates on CaS to form complex sulfides, which function effectively as a ferrite product nucleus. The ACR value is preferably in the range of 0.2 to 0.8.

$$5.5[C]^{4/3}+15[P]+0.90[Mn]+0.12[Ni]+7.9[Nb]^{1/2}+0.53[Mo]\leq 3.70$$

The value of $5.5[C]^{4/3}+15[P]+0.90[Mn]+0.12[Ni]+7.9[Nb]^{1/2}+0.53[Mo]$ is the hardness index of the central segregation area formed by components that are likely to be concentrated in the central segregation area and is referred to below as the Ceq* value. A CTOD test is carried out over the entire thickness of a steel plate. Accordingly, test pieces used in the test include central segregation. If the composition concentration in the central segregation is significant, a hardened region occurs in the heat-affected zone, preventing a good CTOD value from being obtained. By controlling the Ceq* value to be in an appropriate range, an excessive increase in hardness in the central segregation area can be suppressed, and an excellent CTOD property can be obtained even in the weld zone of thick steel material. The appropriate range of the Ceq* value has been experimentally obtained. When the Ceq* value exceeds 3.70, the CTOD property is degraded. Therefore, the Ceq* value is set to be 3.70 or less, preferably 3.50 or less.

The basic chemical composition of this disclosure has been described, but in order to further improve the steel properties, at least one selected from the group consisting of Cu: 0.7% or less, Cr: 0.1% to 1.0%, and V: 0.005% to 0.050% may be added.

Cu: 0.7% or less

Cu is effective for increasing the strength of the base metal. To this end, Cu is preferably added in an amount of 0.1% or more. If the amount added exceeds 0.7%, however, the hot ductility deteriorates. Hence, the amount is preferably 0.7% or less, more preferably 0.6% or less.

Cr: 0.1% to 1.0%

Cr is an element effective in increasing the strength of the base metal. In order to obtain this effect, the Cr content is preferably set to 0.1% or more. However, since excess Cr adversely affects toughness, the Cr content is preferably set to 1.0% or less when added, and more preferably 0.2% to 0.8%.

V: 0.005% to 0.050%

V is an element that is effective in improving the strength and toughness of the base metal at a content of 0.005% or more. Setting the V content to exceed 0.050%, however, leads to deterioration of toughness. Therefore, the V content is preferably 0.005% to 0.050% when added.

Furthermore, specifying the toughness of the central segregation area in the steel plate as indicated below is useful for improving the CTOD property.

$$Hv\max/Hv\text{ave} \leq 1.35+0.006/[C]-t/500$$

First, in the expression above, Hvmax is the maximum Vickers hardness of the central segregation area, Hvave is the average Vickers hardness of a portion excluding the central segregation area and sections from both front and back surfaces inward to ¼ of the plate thickness, [C] is the C content (mass %), and t is the plate thickness (mm).

In other words, Hvmax/Hvave is a dimensionless parameter expressing the hardness of the central segregation area. If this value becomes higher than the value calculated by 1.35 +0.006/[C]−t/500, the CTOD value degrades. Therefore, Hvmax/Hvave is preferably set to be equal to or less than 1.35 +0.006/[C]−t/500, more preferably equal to or less than 1.25+0.006/[C]−t/500.

Hvmax is calculated by measuring, in the thickness direction of the steel plate, a (plate thickness/40) mm range that includes the central segregation area in a Vickers hardness tester (load of 10 kgf) at 0.25 mm intervals in the plate thickness direction and taking the maximum value among the resulting measured values. Hvave is calculated as the average of values obtained by measuring a range between a position at ¼ plate thickness from the steel plate front surface and a position at ¼ plate thickness from the back surface, excluding the central segregation area, in a Vickers hardness tester with a load of 10 kgf at constant intervals in the plate thickness direction (for example, 1 mm to 2 mm).

Next, a method for producing the steel plate of this disclosure is described in detail.

Molten steel adjusted to have a chemical composition according to this disclosure is prepared by steelmaking with an ordinary method using a converter, an electric heating furnace, a vacuum melting furnace, or the like. Next, after forming the molten steel into a slab by continuous casting, the slab is hot rolled to a desired plate thickness. The result is then cooled and tempered. During the hot rolling, it is particularly important to specify the slab reheating temperature and rolling reduction.

In this disclosure, unless otherwise noted, the temperature conditions on the steel plate are prescribed by the temperature at the central portion in the plate thickness direction of the steel plate. The temperature at the central portion in the plate thickness direction is determined from the plate thickness, the surface temperature, the cooling conditions, and the like by simulation calculation or the like. For example, the temperature at the central portion in the plate thickness direction may be determined by calculating the temperature distribution in the plate thickness direction using the finite difference method.

Slab Reheating Temperature: 1030° C. to 1200° C.

The slab reheating temperature is set to 1030° C. or higher in order to remove casting defects in the slab reliably with hot rolling. If the slab is reheated to a temperature exceeding 1200° C., however, the TiN precipitated at the time of solidification coarsens, causing the toughness of the base metal and the weld zone to degrade. Hence, the upper limit on the reheating temperature is set to 1200° C.

Cumulative Rolling Reduction of Hot Rolling in a Temperature Range of 950° C. or Higher: 30% or Higher In order to provide austenite grains with a fine microstructure by recrystallization, the cumulative rolling reduction of hot rolling is set to 30% or higher. The reason is that if the cumulative rolling reduction is less than 30%, abnormal coarse grains formed during reheating remain and adversely affect the toughness of the base metal.

Cumulative Rolling Reduction of Hot Rolling in a Temperature Range of Less than 950° C.: 30% to 70%

In this temperature range, the rolled austenite grains do not sufficiently recrystallize. Therefore, austenite grains that remain flattened after rolling constitute a state of high internal distortion that includes numerous defects, such as an internal distortion zone. These austenite grains act as the driving force for ferrite transformation and encourage ferrite transformation.

If the cumulative rolling reduction is less than 30%, however, accumulation of internal energy due to internal distortion is insufficient, making it difficult for ferrite transformation to occur and reducing the toughness of the base metal. Conversely, if the cumulative rolling reduction exceeds 70%, generation of polygonal ferrite is encouraged, making high strength and high toughness incompatible.

Cooling Rate of 1.0° C./s or Higher to 600° C. or Below

After hot rolling, accelerated cooling is performed at a cooling rate of 1.0° C./s or higher to 600° C. or below. In other words, if the cooling rate is less than 1.0° C./s, sufficient strength of the base metal is not obtained. Furthermore, if cooling is stopped at a higher temperature than 600° C., the proportion of ferrite and pearlite structure, upper bainite structure, and the like increases, making high strength and high toughness incompatible. No lower limit is placed on the stop temperature of accelerated cooling when tempering the steel after accelerated cooling. On the other hand, when the steel is not tempered in a later step, the stop temperature of the accelerated cooling is preferably set to 350° C. or higher.

Tempering Temperature: 450° C. to 650° C.

A sufficient tempering effect is not obtained if the tempering temperature is less than 450° C. On the other hand, when tempering at a temperature exceeding 650° C., coarse carbonitrides precipitate, lowering the toughness and causing the strength of the steel to deteriorate. Hence, a temperature exceeding 650° C. is not preferable. The tempering is more preferably performed by induction heating, which suppresses coarsening of carbides during tempering. In this case, the temperature at the center of the steel plate calculated by a simulation using the finite difference method or the like is controlled to be from 450° C. to 650° C.

In the steel of this disclosure, coarsening of austenite grains in the heat-affected zone is suppressed, and nuclei for ferrite transformation that do not dissolve even at high temperatures are finely dispersed to refine the microstructure of the heat-affected zone. High toughness is thus obtained. Also, in an area reheated to a dual phase by the thermal cycle at the time of multilayer welding, the microstructure of the heat-affected zone due to initial welding is refined. Therefore, in the dual phase reheating area, the toughness of the non-transformed area can be improved, the austenite grains that undergo retransformation can be refined, and the extent of reduction in toughness can be reduced.

EXAMPLES

Using continuously-cast slabs having the chemical composition of steels A to Z and A1 listed in Table 1 as raw material, hot rolling and heat treatment were performed to produce thick steel plates with a thickness of 50 mm to 100 mm. The base metal was evaluated by a tensile test in which JIS No. 4 test pieces were collected from the ½ position along the thickness of the steel plates, so that the longitudinal direction of each test piece was perpendicular to the rolling direction of the steel plate. The yield stress (YS) and tensile strength (TS) were then measured in accordance with JIS Z 2241.

A Charpy impact test was also performed by collecting JIS V-notch test pieces from the ½ position along the thickness of the steel plates, so that the longitudinal direction of each test piece was perpendicular to the rolling direction of the steel plate. The absorbed energy $vE_{-40}$° C. at −40° C. was then measured. For test pieces satisfying all of the following relationships, the base metal properties were evaluated as good: YS≥460 MPa, TS≥570 MPa, and $vE_{-40°\,C.}$≥200 J.

The toughness of the weld zone was evaluated by producing a multilayer fill weld joint, using a single bevel groove, by submerged arc welding having a welding heat input of 35 kJ/cm and then measuring the absorbed energy $vE_{-40°\,C.}$ at −40° C. with a Charpy impact test, using the weld bond on the straight side at the ¼ position along the thickness of the steel plates as the notch position for the test. The toughness of the weld zone was determined to be good when the mean for three tests satisfied the relationship $vE_{-40°\,C.}$≥150 J.

Using the weld bond at the straight side as the notch position for the three-point bending CTOD test pieces, the CTOD value at −10° C., i.e. $\delta_{-10°\,C.}$, was measured. The CTOD property of the weld joint was determined to be good when the minimum of the CTOD value ($\delta_{-10°\,C.}$) over three tests was 0.50 mm or greater.

Table 2 lists the hot rolling conditions, heat treatment conditions, base metal properties, and the results of the above-described Charpy impact test and CTOD test on the weld zone. No weld was produced, and hence weld evaluation was not performed, in a portion of the steel plates for which the strength or toughness of the base metal did not reach the target.

In Table 1, steels A to E and A1 are Examples, whereas steels F to Z are Comparative Examples in which the value of at least one of the components in the chemical composition is outside of the range of this disclosure.

Sample numbers 1 to 10 and 31 are all Examples for which the results of the Charpy impact test on the weld bond and the results of the three-point bending CTOD test on the weld bond were satisfactory. In particular, in sample numbers 4 and 5, YS of 460 MPa or greater was obtained even when Ceq was within the range of this disclosure and the plate thickness was from 50 mm to 100 mm.

By contrast, in sample numbers 11 to 30, the steel chemical composition was outside of the range of this disclosure, and either the toughness of the base metal was unsatisfactory, or the results of the Charpy impact test on the weld bond and the results of the three-point bending CTOD test on the weld bond were unsatisfactory.

TABLE 1

| No. | C | Si | Mn | P | S | Al | Ni | Nb | Ti | B | N |
|---|---|---|---|---|---|---|---|---|---|---|---|
| A | 0.061 | 0.19 | 1.61 | 0.005 | 0.0013 | 0.034 | 0.65 | 0.017 | 0.010 | 0.0002 | 0.0029 |
| B | 0.052 | 0.09 | 1.83 | 0.007 | 0.0009 | 0.038 | 0.73 | 0.025 | 0.013 | 0.0001 | 0.0038 |
| C | 0.068 | 0.19 | 1.62 | 0.003 | 0.0023 | 0.018 | 1.22 | 0.021 | 0.009 | 0.0002 | 0.0037 |
| D | 0.063 | 0.17 | 1.41 | 0.004 | 0.0025 | 0.030 | 1.12 | 0.018 | 0.008 | 0.0002 | 0.0030 |
| E | 0.051 | 0.20 | 1.81 | 0.003 | 0.0013 | 0.025 | 1.27 | 0.017 | 0.007 | 0.0002 | 0.0021 |
| F | 0.094 | 0.09 | 1.67 | 0.005 | 0.0010 | 0.031 | 0.68 | 0.020 | 0.012 | 0.0001 | 0.0037 |
| G | 0.069 | 0.44 | 1.40 | 0.006 | 0.0022 | 0.041 | 1.05 | 0.021 | 0.008 | 0.0002 | 0.0034 |
| H | 0.067 | 0.12 | 1.22 | 0.004 | 0.0021 | 0.026 | 1.17 | 0.016 | 0.007 | 0.0002 | 0.0036 |
| I | 0.060 | 0.10 | 2.41 | 0.002 | 0.0013 | 0.031 | 0.58 | 0.015 | 0.007 | 0.0002 | 0.0022 |
| J | 0.068 | 0.15 | 1.88 | 0.016 | 0.0020 | 0.018 | 0.51 | 0.012 | 0.011 | 0.0001 | 0.0039 |
| K | 0.070 | 0.09 | 1.66 | 0.006 | 0.0018 | 0.074 | 1.25 | 0.022 | 0.009 | 0.0002 | 0.0032 |
| L | 0.070 | 0.22 | 1.49 | 0.006 | 0.0017 | 0.025 | 1.33 | 0.031 | 0.010 | 0.0012 | 0.0036 |
| M | 0.057 | 0.11 | 1.54 | 0.004 | 0.0010 | 0.032 | 1.11 | 0.021 | 0.010 | 0.0002 | 0.0029 |
| N | 0.055 | 0.07 | 1.97 | 0.005 | 0.0024 | 0.030 | 0.66 | 0.051 | 0.009 | 0.0002 | 0.0027 |
| P | 0.060 | 0.09 | 1.51 | 0.006 | 0.0022 | 0.022 | 0.75 | 0.031 | 0.034 | 0.0001 | 0.0036 |
| Q | 0.062 | 0.05 | 1.62 | 0.004 | 0.0014 | 0.031 | 1.48 | 0.023 | 0.012 | 0.0001 | 0.0075 |
| R | 0.063 | 0.17 | 1.67 | 0.006 | 0.0018 | 0.021 | 0.95 | 0.022 | 0.013 | 0.0002 | 0.0040 |
| S | 0.067 | 0.05 | 1.54 | 0.006 | 0.0010 | 0.029 | 0.93 | 0.028 | 0.011 | 0.0001 | 0.0032 |
| T | 0.062 | 0.22 | 1.64 | 0.002 | 0.0012 | 0.025 | 0.51 | 0.019 | 0.012 | 0.0001 | 0.0042 |
| U | 0.054 | 0.15 | 1.68 | 0.006 | 0.0006 | 0.027 | 0.94 | 0.028 | 0.014 | 0.0001 | 0.0043 |
| V | 0.069 | 0.20 | 1.54 | 0.002 | 0.0011 | 0.017 | 0.58 | 0.021 | 0.013 | 0.0002 | 0.0039 |
| W | 0.079 | 0.21 | 1.53 | 0.004 | 0.0021 | 0.016 | 1.17 | 0.016 | 0.007 | 0.0002 | 0.0021 |
| X | 0.067 | 0.11 | 1.58 | 0.004 | 0.0014 | 0.036 | 1.38 | 0.025 | 0.006 | 0.0001 | 0.0048 |
| Y | 0.059 | 0.21 | 1.65 | 0.005 | 0.0012 | 0.037 | 0.73 | 0.030 | 0.019 | 0.0001 | 0.0021 |
| Z | 0.089 | 0.06 | 1.78 | 0.007 | 0.0013 | 0.036 | 0.55 | 0.045 | 0.010 | 0.0001 | 0.0027 |
| A1 | 0.059 | 0.07 | 1.55 | 0.002 | 0.0024 | 0.025 | 0.74 | 0.020 | 0.009 | 0.0002 | 0.0037 |
| A2 | 0.064 | 0.03 | 1.78 | 0.004 | 0.0011 | 0.031 | 1.68 | 0.024 | 0.011 | 0.0001 | 0.0031 |
| A3 | 0.078 | 0.21 | 1.98 | 0.007 | 0.0032 | 0.027 | 0.21 | 0.035 | 0.011 | 0.0002 | 0.0035 |

| No. | Ca | Cu | Cr | Mo | V | O | Ceq | Ti/N | Formula (2) | Formula (3) | Notes |
|---|---|---|---|---|---|---|---|---|---|---|---|
| A | 0.0021 | 0.32 | — | 0.29 | — | 0.0026 | 0.452 | 3.45 | 0.57 | 2.92 | Example |
| B | 0.0014 | 0.21 | 0.12 | 0.13 | — | 0.0020 | 0.470 | 3.42 | 0.60 | 3.26 | Example |
| C | 0.0021 | 0.22 | — | 0.11 | — | 0.0013 | 0.456 | 2.43 | 0.53 | 3.01 | Example |
| D | 0.0022 | — | 0.31 | 0.17 | — | 0.0014 | 0.469 | 2.67 | 0.50 | 2.75 | Example |
| E | 0.0017 | — | — | 0.26 | 0.017 | 0.0023 | 0.493 | 3.33 | 0.48 | 3.10 | Example |

TABLE 1-continued

| | | | | | | | | | | | |
|---|---|---|---|---|---|---|---|---|---|---|---|
| F | 0.0017 | — | — | 0.23 | — | 0.0023 | 0.463 | 3.24 | 0.62 | 3.13 | Comparative Example |
| G | 0.0011 | — | 0.12 | 0.30 | 0.023 | 0.0015 | 0.461 | 2.35 | 0.22 | 2.93 | Comparathie Example |
| H | 0.0025 | 0.22 | — | 0.17 | — | 0.0013 | 0.397 | 1.94 | 0.70 | 2.54 | Comparative Example |
| I | 0.0018 | — | 0.22 | 0.16 | — | 0.0022 | 0.575 | 3.18 | 0.55 | 3.45 | Comparative Example |
| J | 0.0021 | — | — | 0.18 | 0.019 | 0.0011 | 0.455 | 2.82 | 0.64 | 3.11 | Comparative Example |
| K | 0.0029 | — | — | 0.24 | — | 0.0021 | 0.477 | 2.81 | 0.77 | 3.19 | Comparative Example |
| L | 0.0010 | 0.14 | — | 0.14 | — | 0.0023 | 0.445 | 2.78 | 0.14 | 3.22 | Comparative Example |
| M | 0.0019 | 1.24 | — | 0.22 | — | 0.0024 | 0.515 | 3.45 | 0.70 | 2.96 | Comparative Example |
| N | 0.0025 | 0.35 | — | 0.14 | — | 0.0011 | 0.479 | 3.33 | 0.65 | 3.90 | Comparative Example |
| P | 0.0024 | 0.15 | 0.22 | 0.18 | 0.012 | 0.0022 | 0.454 | 9.44 | 0.48 | 3.16 | Comparative Example |
| Q | 0.0028 | — | — | 0.18 | — | 0.0020 | 0.466 | 1.60 | 0.98 | 3.12 | Comparative Example |
| R | 0.0016 | — | 1.48 | 0.23 | 0.015 | 0.0023 | 0.749 | 3.25 | 0.31 | 3.14 | Comparative Example |
| S | 0.0018 | — | — | 0.88 | — | 0.0016 | 0.562 | 3.44 | 0.91 | 3.53 | Comparative Example |
| T | 0.0022 | 0.26 | — | 0.29 | 0.081 | 0.0020 | 0.460 | 2.86 | 0.85 | 2.94 | Comparative Example |
| U | 0.0006 | — | — | 0.25 | 0.012 | 0.0029 | 0.449 | 3.26 | −0.20 | 3.28 | Comparative Example |
| V | 0.0039 | — | 0.26 | 0.18 | — | 0.0010 | 0.452 | 3.33 | 2.34 | 2.88 | Comparative Example |
| W | 0.0029 | 0.41 | 0.26 | 0.45 | — | 0.0012 | 0.581 | 3.33 | 0.85 | 3.00 | Comparative Example |
| X | 0.0025 | 0.33 | — | 0.11 | 0.011 | 0.0027 | 0.468 | 1.25 | 0.65 | 3.10 | Comparative Example |
| Y | 0.0021 | 0.36 | 0.11 | 0.14 | — | 0.0019 | 0.456 | 9.05 | 0.83 | 3.21 | Comparative Example |
| Z | 0.0016 | — | — | 0.41 | — | 0.0024 | 0.504 | 3.70 | 0.41 | 3.88 | Comparative Example |
| A1 | 0.0025 | 0.29 | 0.21 | 0.16 | — | 0.0017 | 0.460 | 2.43 | 0.55 | 2.84 | Example |
| A2 | 0.0022 | — | — | — | — | 0.0019 | 0.473 | 3.55 | 0.96 | 3.23 | Example |
| A3 | 0.0007 | 0.35 | — | — | 0.03 | 0.0022 | 0.452 | 3.14 | 0.03 | 3.57 | Comparative Example |

Underlined values are outside of the range of this disclosure

Formula (1): Ceq = [C] + [Mn]/6 + ([Cu] + [Ni])/15 + ([Cr] + [Mo] + [V])/5

Formula (2): {[Ca] − (0.18 + 130 × [Ca]) × [O]}/1.25/[S]

Formula (3): $5.5[C]^{4/3} + 15[P] + 0.90[Mn] + 0.12[Ni] + 7.9[Nb]^{1/2} + 0.53[Mo]$

TABLE 2

| No. | Steel No. | Rolling Conditions: Reheating Temperature (° C.) | Rolling Conditions: Cumulative Rolling Reduction Ratio at 950° C. or Higher (%) | Rolling Conditions: Cumulative Rolling Reduction Ratio at Less Than 950° C. (%) | Plate Thickness (mm) | Final Temperature (° C.) | Cooling Conditions: Cooling Rate (° C./s) | Cooling Conditions: Cooling Stop Temperature (° C.) | Tempering Temperature (° C.) | Base Metal Properties: YP (MPa) | Base Metal Properties: TS (MPa) | Base Metal Properties: $vE_{-40° C.}$ (J) | Base Metal Properties: Left-Hand Side of Formula (4) | Base Metal Properties: Right-Hand Side of Formula (4) | Weld Zone Properties: $vE_{-40° C.}$ (J) | Weld Zone Properties: CTOD $\delta_{-10° C.}$ (mm) | Notes |
|---|---|---|---|---|---|---|---|---|---|---|---|---|---|---|---|---|---|
| 1 | A | 1039 | 50 | 50 | 75 | 780 | 5 | 220 | 560 | 524 | 604 | 227 | 1.25 | 1.30 | 178 | 1.350 | Example |
| 2 | A | 1117 | 50 | 53 | 70 | 720 | 5 | 220 | 550 | 531 | 607 | 254 | 1.27 | 1.31 | 165 | 0.987 | Example |
| 3 | A | 1235 | 62 | 56 | 50 | 760 | 10 | 260 | 580 | 541 | 620 | 46 | 1.26 | 1.35 | 89 | 0.359 | Example |
| 4 | B | 1055 | 22 | 79 | 50 | 750 | 10 | 210 | 600 | 534 | 641 | 89 | 1.21 | 1.37 | 154 | 0.749 | Example |
| 5 | B | 1073 | 40 | 44 | 100 | 700 | 2 | 110 | 590 | 533 | 601 | 205 | 1.22 | 1.27 | 165 | 0.846 | Example |
| 6 | C | 1123 | 35 | 64 | 70 | 760 | 5 | 100 | 590 | 515 | 611 | 241 | 1.06 | 1.30 | 191 | 1.546 | Example |
| 7 | D | 1099 | 46 | 57 | 70 | 760 | 5 | 290 | 560 | 527 | 600 | 283 | 1.23 | 1.31 | 159 | 0.937 | Example |
| 8 | D | 1042 | 38 | 62 | 70 | 790 | 5 | 620 | 550 | 375 | 508 | 142 | 1.26 | 1.31 | 167 | 0.109 | Example |
| 9 | E | 1033 | 47 | 69 | 50 | 770 | 10 | 220 | 690 | 411 | 546 | 250 | 1.21 | 1.37 | 151 | 1.241 | Example |
| 10 | E | 1118 | 48 | 68 | 50 | 790 | 10 | 250 | 590 | 510 | 652 | 264 | 1.20 | 1.37 | 165 | 1.356 | Example |
| 11 | F | 1040 | 42 | 60 | 70 | 740 | 5 | 250 | 590 | 528 | 635 | 127 | 1.53 | 1.27 | 34 | 0.256 | Comparative Example |
| 12 | G | 1047 | 50 | 53 | 70 | 760 | 5 | 450 | 645 | 478 | 604 | 148 | 1.13 | 1.30 | 29 | 0.125 | Comparative Example |
| 13 | H | 1116 | 52 | 51 | 70 | 700 | 5 | 190 | 560 | 412 | 512 | 271 | 1.26 | 1.30 | — | — | Comparative Example |
| 14 | I | 1090 | 47 | 56 | 70 | 760 | 5 | 140 | 610 | 567 | 687 | 49 | 1.45 | 1.31 | — | — | Comparative Example |
| 15 | J | 1104 | 55 | 48 | 70 | 750 | 5 | 260 | 560 | 501 | 605 | 281 | 1.23 | 1.30 | 35 | 0.126 | Comparative Example |
| 16 | K | 1042 | 49 | 67 | 50 | 790 | 10 | 220 | 570 | 546 | 641 | 128 | 1.03 | 1.34 | — | — | Comparative Example |
| 17 | L | 1080 | 65 | 52 | 50 | 740 | 10 | 110 | 550 | 478 | 578 | 277 | 1.01 | 1.34 | 21 | 0.120 | Comparative Example |
| 18 | M | 1072 | 64 | 54 | 50 | 740 | 10 | 190 | 560 | 588 | 639 | 110 | 1.05 | 1.36 | — | — | Comparative Example |
| 19 | N | 1110 | 60 | 58 | 50 | 790 | 10 | 290 | 590 | 567 | 684 | 249 | 1.13 | 1.36 | 34 | 0.131 | Comparative Example |
| 20 | P | 1088 | 39 | 45 | 100 | 780 | 2 | 130 | 560 | 503 | 614 | 61 | 1.13 | 1.25 | — | — | Comparative Example |
| 21 | Q | 1031 | 46 | 38 | 100 | 730 | 2 | 150 | 590 | 522 | 578 | 235 | 1.04 | 1.25 | 46 | 0.137 | Comparative Example |
| 22 | R | 1073 | 46 | 38 | 100 | 750 | 2 | 140 | 590 | 579 | 689 | 268 | 1.01 | 1.25 | 22 | 0.223 | Comparative Example |
| 23 | S | 1036 | 48 | 55 | 70 | 750 | 5 | 220 | 570 | 614 | 704 | 78 | 1.06 | 1.30 | — | — | Comparative Example |
| 24 | T | 1031 | 31 | 66 | 70 | 730 | 5 | 240 | 550 | 607 | 702 | 34 | 1.06 | 1.31 | — | — | Comparative Example |
| 25 | U | 1127 | 37 | 63 | 70 | 710 | 5 | 200 | 600 | 497 | 588 | 233 | 1.04 | 1.32 | 56 | 0.235 | Comparative Example |

TABLE 2-continued

| | | Rolling Conditions | | | | | Cooling Conditions | | | Base Metal Properties | | | | | Weld Zone Properties | | |
|---|---|---|---|---|---|---|---|---|---|---|---|---|---|---|---|---|---|
| No. | Steel No. | Reheating Temperature (° C.) | Cumulative Rolling Reduction Ratio at 950° C. or Higher (%) | Cumulative Rolling Reduction Ratio at Less Than 950° C. (%) | Plate Thickness (mm) | Final Temperature (° C.) | Cooling Rate (° C./s) | Cooling Stop Temperature (° C.) | Tempering Temperature (° C.) | YP (MPa) | TS (MPa) | $vE_{-40° C.}$ (J) | Left-Hand Side of Formula (4) | Right-Hand Side of Formula (4) | $vE_{-40° C.}$ (J) | CTOD $\delta_{-10° C.}$ (mm) | Notes |
| 26 | V | 1111 | 41 | 60 | 70 | 780 | 5 | 210 | 610 | 506 | 596 | 216 | 1.05 | 1.30 | 141 | 0.482 | Comparative Example |
| 27 | W | 1041 | 40 | 61 | 70 | 780 | 5 | 100 | 600 | 574 | 702 | 56 | 1.45 | 1.29 | — | — | Comparative Example |
| 28 | X | 1054 | 33 | 65 | 70 | 740 | 5 | 180 | 570 | 452 | 638 | 254 | 1.15 | 1.30 | 89 | 0.211 | Comparative Example |
| 29 | Y | 1088 | 33 | 65 | 70 | 720 | 5 | 270 | 610 | 471 | 593 | 276 | 1.29 | 1.31 | 74 | 0.356 | Comparative Example |
| 30 | Z | 1110 | 49 | 54 | 70 | 740 | 5 | 290 | 580 | 539 | 687 | 56 | 1.46 | 1.28 | 47 | 0.097 | Comparative Example |
| 31 | A1 | 1121 | 48 | 55 | 70 | 710 | 5 | 280 | 550 | 531 | 607 | 211 | 1.47 | 1.31 | 41 | 0.119 | Example |
| 32 | A2 | 1102 | 45 | 60 | 75 | 720 | 5 | 240 | 540 | 514 | 615 | 284 | 1.19 | 1.29 | 221 | 1.180 | Example |
| 33 | A3 | 1115 | 50 | 53 | 70 | 730 | 5 | 280 | 540 | 503 | 641 | 251 | 1.28 | 1.29 | 84 | 0.310 | Comparative Example |

Underlined values are outside of the range of this disclosure

Formula (4): $HVmax/HVave \leq 1.35 + 0.006/[C] - t/500$

The invention claimed is:

1. A high-tensile-strength steel plate, comprising:

a chemical composition including, by mass %,

C: 0.02% to 0.08%,

Si: 0 01% to 0.35%,

Mn: 1.4% to 2.0%,

P: 0.007% or less,

S: 0.0035% or less,

Al: 0.010% to 0.060%,

Ni: 0.5% to 2.0%,

Mo: 0.10% to 0.50%,

Nb: 0.005% to 0.040%,

Ti: 0.005% to 0.025%,

B: less than 0.0003%,

N: 0.002% to 0.005%,

Ca: 0.0005% to 0.0050%, and

O: 0.0030% or less,

Ceq specified by formula (1) below being from 0.420 to 0.520, Ti/N being from 1.5 to 4.0, formulas (2) and (3) below being, satisfied, and a balance being Fe and incidental impurities:

$$Ceq=[C]+[Mn]/6+([Cu]+[Ni])/15+([Cr]+[Mo]+[V])/5 \quad (1)$$

$$0<\{[Ca]-(0.18+130\times[Ca])\times[O]\}/1.25/[S]<1 \quad (2)$$

$$5.5[C]^{4/3}+15[P]+0.90[Mn]+0.12[Ni]+7.9[Nb]^{1/2}+0.53[Mo]\leq 3.70 \quad (3)$$

where brackets [ ] indicate the content by mass % of the element in the brackets, and, wherein a hardness of a central segregation area of the steel plate satisfies formula (4) below:

$$Hv\max/Hv\text{ave} \leq 1.35+0.006/[C]-t/500 \quad (4)$$

where Hvmax is a maximum Vickers hardness of the central segregation area,

Hvave is an average Vickers hardness of a portion excluding the central segregation area and sections from both front and back surfaces inward to ¼ of a plate thickness,

[C] is the C content by mass %, and t is a plate thickness of the steel plate in millimeters.

2. The high-tensile-strength steel plate of claim 1, wherein the chemical composition further includes, by mass %, at least one selected from the group consisting of:

Cu: 0.7% or less,

Cr: 0.1% to 1.0%, and

V: 0.005% to 0.050%.

3. A method for producing a high-tensile-strength steel plate, the method comprising:

heating steel having the chemical composition of claim 1 to a temperature from 1030° C. to 1200° C.;

subsequently subjecting the steel to hot rolling at a cumulative rolling reduction of 30% or higher in a temperature range of 950° C. or higher and a cumulative rolling reduction of 30% to 70% in a temperature range of less than 950° C.;

subsequently cooling the steel to 600° C. or below with a cooling rate of 1.0° C./s or higher; and subsequently tempering the steel at 450° C. to 650° C.

4. A method for producing a high-tensile strength steel plate, the method comprising:

heating steel having the chemical composition of claim 2 to a temperature from 1030° C. to 1200° C.;

subsequently subjecting the steel to hot rolling at a cumulative rolling reduction of 30% or higher in a temperature range of 950° C. or higher and a cumulative rolling reduction of 30% to 70% in a temperature range of less than 950° C.;

subsequently cooling the steel to 600° C. or below with a cooling rate of 1.0° C./s or higher; and subsequently tempering the steel at 450 to 650° C.

* * * * *